US005377635A

United States Patent [19]

Glover

[11] Patent Number: 5,377,635

[45] Date of Patent: Jan. 3, 1995

[54] ROTARY THROTTLE VALVE AND UTILIZATION OF SAID THROTTLE VALVE FOR THE TRANSFER OF A FLUID TO A COMBUSTION CHAMBER OF AN INTERNAL-COMBUSTION ENGINE

[75] Inventor: Stephen Glover, Rueil Malmaison, France

[73] Assignee: Institut Francais du Petrole, Rueil Malmaison, France

[21] Appl. No.: 39,116

[22] PCT Filed: Jul. 31, 1992

[86] PCT No.: PCT/FR92/00757

§ 371 Date: May 4, 1993

§ 102(e) Date: May 4, 1993

[87] PCT Pub. No.: WO93/03260

PCT Pub. Date: Feb. 18, 1993

[30] Foreign Application Priority Data

Aug. 2, 1991 [FR] France ..... 91 09917

[51] Int. Cl.[6] ..... F01L 7/02

[52] U.S. Cl. ..... 123/336; 123/190.1

[58] Field of Search ..... 123/336, 296, 298, 190.6, 123/190.1, 190.8, 190.2, 188.9, 190.16

[56] References Cited

U.S. PATENT DOCUMENTS

| | | | |
|---|---|---|---|
| 2,158,386 | 5/1939 | Sykes | 123/190.8 |
| 3,871,340 | 3/1975 | Zimmerman | 123/190.8 |
| 4,007,725 | 2/1977 | Weaver | 123/190.1 |
| 4,075,986 | 2/1978 | Keck | 123/190.1 |
| 4,546,743 | 10/1985 | Eickmann | 123/190.16 |
| 4,834,038 | 5/1989 | Montagni | 123/190.16 |
| 5,052,349 | 10/1991 | Buelna | 123/190.6 |
| 5,074,265 | 12/1991 | Ristin et al. | 123/190.8 |
| 5,081,966 | 1/1992 | Hansen | 123/190.6 |

FOREIGN PATENT DOCUMENTS

| | | | |
|---|---|---|---|
| 2662214 | 11/1991 | France | 123/190.1 |
| 9119889 | 12/1991 | WIPO | 123/190.1 |

*Primary Examiner*—E. Rollins Cross
*Assistant Examiner*—Erick Solis
*Attorney, Agent, or Firm*—Antonelli, Terry, Stout & Kraus

[57] ABSTRACT

A rotary throttle valve for transferring a fluid between a fluid source and a combustion chamber of an internal-combustion engine, comprising at least one substantially cylindrical surface and a side wall. The rotary throttle valve includes at least one fluid flow channel having an inlet and an outlet, with the inlet belonging to the side wall of the valve and being positioned at a distance, which is not zero, from the rotation axis of the rotary valve, and the outlet belonging to the cylindrical surface of the valve and being radially offset with respect to the inlet.

11 Claims, 2 Drawing Sheets

ROTARY THROTTLE VALVE AND UTILIZATION OF SAID THROTTLE VALVE FOR THE TRANSFER OF A FLUID TO A COMBUSTION CHAMBER OF AN INTERNAL-COMBUSTION ENGINE

FIELD OF THE INVENTION

The present invention relates to a rotary throttle valve for transferring a fluid between a fluid source and a combustion chamber of an internal-combustion engine, comprising at least one substantially cylindrical surface and a side wall.

More particularly, the present invention relates to a rotary throttle valve for controlling the intake of gas, notably of an air-fuel mixture, into a combustion chamber of an engine, comprising an intrinsic sealing system.

The present invention applies to two-stroke or four-stroke internal-combustion engines having one or several cylinders supplied by a gas, notably an air-fuel mixture.

BACKGROUND OF THE INVENTION

Delivery of a carbureted mixture into the combustion chamber may be achieved through parts driven by a reciprocating motion, such as valves. A system of this type is proposed in patent application EN-89/17,484.

However, engine performances may be limited by valve injection systems, notably concerning control of the beginning and of the end of the injection process and the opening area for the carbureted air (oscillation problems).

Moreover, these systems have to be mounted in cylinder heads of relatively large size. One improvement consists in using rotary throttle valves for the control and delivery of a carbureted mixture.

Thus, patent application EN-90/06,323 provides the use of rotary throttle valves for controlling the pneumatic injection of fuel into a two-stroke engine.

The throttle valves disclosed have a rotational axis located in a plane perpendicular to the axis of the cylinder. Throttle valves are pierced with a transverse channel for communicating the linking channel with the combustion chamber and they are connected to driving means for rotating them as a function of the rotational speed of the engine crankshaft.

In comparison with valves, such throttle valves may be run at a higher speed and allow a higher flexibility in the injection adjustment.

However, sealing problems remain, notably at the throttle valve inlet.

Sealing devices are sometimes provided to that end, either upstream or downstream from each throttle valve, or in both places.

Patent application FR-2,559,208 relates to a throttle valve for controlling the exhaust and/or the intake of gas from and/or towards a combustion chamber, and on which one or several sealing parts are applied. The improvement envisaged in this patent consists of a lubrication and a refrigeration of the contact surface between the sealing part(s) and the throttle valve.

The sophistication of this system does not ensure perfect reliability, notably concerning sealing.

SUMMARY OF THE INVENTION

The present invention proposes a rotary throttle valve of simple design, which requires no additional sealing part, independent at the level of the intake.

Sealing at the intake is ensured according to the invention by the shape and the lay-out of the throttle valve.

Thus, the invention relates to a rotary throttle valve of the type defined at the beginning of the description.

More particularly, the rotary valve according to the invention comprises at least one flow channel for the fluid having an inlet and an outlet, with the inlet belonging to the lateral surface of the rotary valve and being positioned at a distance, which is not zero, from the rotational axis of the rotary valve. The outlet belongs to the cylindrical surface of the rotary valve and is radially offset with respect to the inlet.

The outlet is positioned at a greater distance from the axis rotation than the inlet.

Furthermore, at least one fuel injector comes out close to the inlet and inside the rotary valve, the injector being oriented in such a way that its axis exhibits an orientation close to that of the face of the channel which is the closest to the axis of rotation of the rotary valve.

Preferably, for each channel co-operating with an injector, the face of the channel which is the furthest from the longitudinal axis of the rotary valve goes further from the axis from the inlet.

Besides, at least one of said flow channels may comprise a means for trapping fuel.

More particularly, the means for trapping the fuel includes an elbow formed by the channel and likely to retain the fuel under the effect of the centrifugal force generated by the rotation of the rotary valve.

According to one embodiment of the invention, the rotary valve is intended to control the intake of an air-fuel mixture into the combustion chamber of an internal-combustion engine.

According to another embodiment of the invention, the rotary valve further comprises, from a given distance from its end opposite the combustion chamber, two channels arranged symmetrically with respect to a longitudinal plane.

More particularly, the rotary valve may comprise an axial channel intended for cooling.

As it has already been mentioned, the rotary valve may be mounted in a single-cylinder engine, located at the inlet of the combustion chamber. Without departing from the scope of the invention, several rotary valves may be mounted, each one in the cylinder head of a combustion chamber of a multi-cylinder engine. A single axial cooling channel then preferably runs through all the rotary valves.

Moreover, one or several rotary valves according to the invention may complete an outboard engine, and their longitudinal axis (axes) may then be vertical.

BRIEF DESCRIPTION OF THE DRAWINGS

Other features and advantages of the invention will be clear from reading the description hereafter given by way of non limitative examples, with reference to the accompanying drawings in which.

DESCRIPTION OF THE PREFERRED EMBODIMENTS

Figure 1:
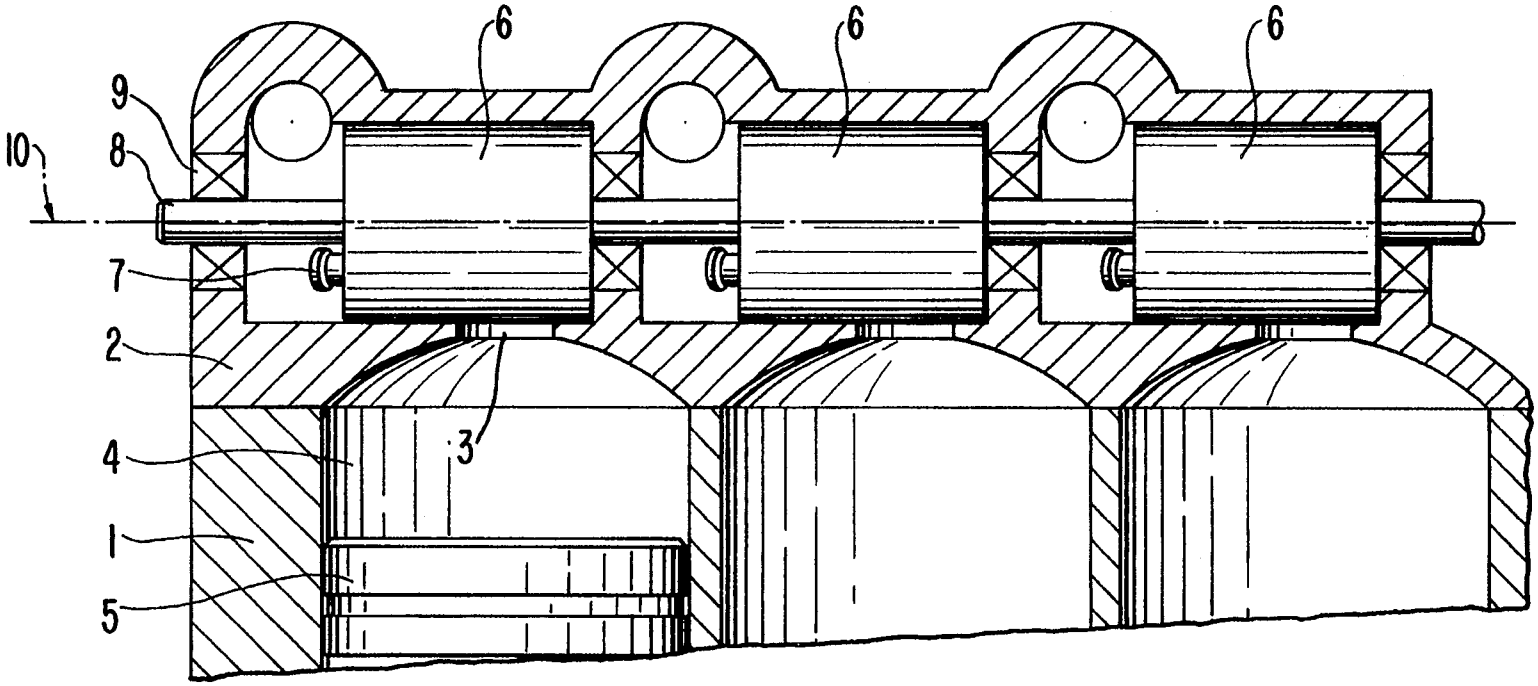
FIG. 1 is a partial longitudinal vertical section of a multi-cylinder engine fitted with rotary valves according to the invention.

FIG. 1 illustrates the lay-out of the rotary valves in the case of a multi-cylinder engine. As apparent from FIG. 1 and as known in the art, the cylinders 1 (three in this example) are each topped by a cylinder head 2 whose hemispherical bottom defines the upper part of the combustion chamber 4, which is also delimited by the walls of cylinder 1 and by the upper part of piston 5.

At the level of each cylinder at least an injection port 3 communicates combustion chamber 4 with at least one rotary throttle valve 6 according to the invention.

According to this embodiment example, throttle valve 6 is rotary in cylinder head 2 and controls the delivery of a mixture of compressed air and of fuel into the combustion chamber 4 since it is positioned between injection port 3 and a compressed air supply pipe (not referenced).

A fuel injection device 7 is preferably located on the compressed air pipe, at the inlet of rotary or throttle valve 6.

According to this embodiment of the invention, each throttle valve, of cylindrical general shape, comprises at least one longitudinal shaft 8 sticking out on at least one side and resting against a bearing 9. The shafts 8 of the various rotaty throttle valves may be positioned end to end.

Preferably, each shaft 8 is hollow, which allows a cooling fluid to be run therethrough, for example, in order to cool the inside of the throttle valve 6. This function is important because of the rotational speeds of the throttle valves 6.

Several rotary throttle valves 6, positioned end, to end enable an axial continuous cooling channel to be formed from one end of the throttle valves 6 to the other.

Without departing from the scope of the invention, a single cylindrical shaft 8 may run through all the throttle valves 6, or shaft sections may be mounted on either side of cylindrical throttle valve 6.

Figure 2:
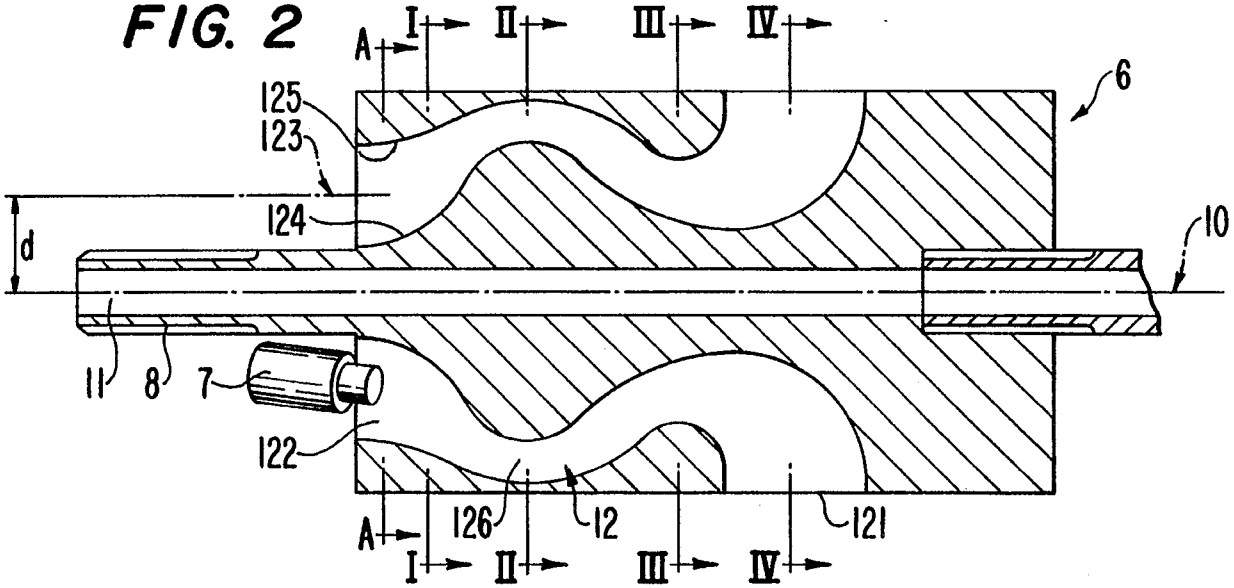
FIG. 2 is a longitudinal section of an embodiment of a rotary throttle valve according to the invention.

As shown in FIG. 2, the general shape of the throttle valve 6 may be cylindrical along a longitudinal rotational axis 10. As it has been stated, an axial channel 11, merged with the rotation axis 10 of the throttle valve 6, allows, for example, a cooling liquid to be circulated inside the throttle valve.

Besides, a channel 12, intended for the flow of a mixture of air under pressure-fuel, for example, is provided within the throttle valve.

Channel 12 is not straight and, preferably, has a variable section and includes a first port or outlet 121 cooperating with the combustion chamber 4 and a second port or inlet 122 through which the mixture is introduced. Inlet 122 belongs to the lateral surface of the throttle valve and is positioned at a distance, which is not zero, from the rotational axis 10 of the throttle valve 6, whereas, the outlet 121 belongs to the cylindrical surface of the throttle valve 6 and is radially offset with respect to the inlet 122. Outlet 121 is, in any case, positioned at a further distance from rotational axis 10 than the inlet 122.

At the level of the inlet 122, the axis or the neutral axis 123 of the channel 12 may be substantially parallel to the rotational axis 10 of the throttle valve 6.

Furthermore, the fuel injector 7 comes out close to the inlet 122, inside the throttle valve 6. More precisely, the injector 7 is oriented in such a way that the axis of the jet of fuel from the fuel injector 7 is substantially contained in the same plane as the wall or face 124 of the channel 12 which is the closest to the rotational axis 10 of the throttle valve 6.

Besides, the wall 125 of channel 12 which is the furthest from the rotational axis 10 is inclined in such a way that it is further from the rotational axis 10 from the end 122 of the throttle valve 6.

The lay-outs which have been described only relate to the zone of channel 12 co-operating directly with an injector 7 and allow sealing to be achieved within the throttle valve, without any additional part. In fact, the orientations of the wall and of injector 7 allow the wall 124 to be hit by the fuel droplets at a low angle, and thus prevents the droplets from leaving the channel 12. Furthermore, because of its orientation, the wall 124 allows the droplets to be carried along more deeply into the channel 12. A fuel film may thus form in this zone.

Figure 3:
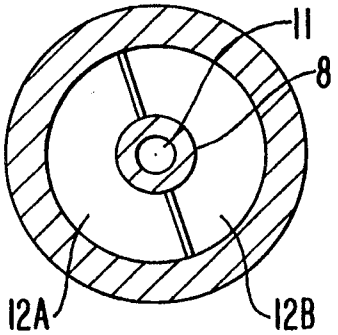
FIG. 3 is a cross-section along the line A—A of FIG. 2.
Figure 4:
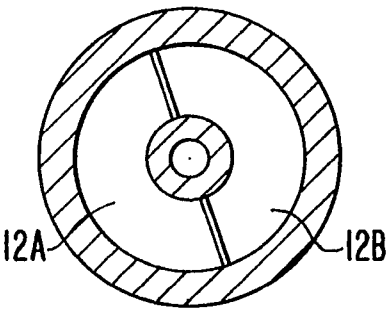
FIG. 4 is a cross-section along the line I—I of FIG. 2.

FIGS. 3 and 4 allow the geometry of the throttle valve 6 at the level of inlet 122 to be better understood. FIGS. 3 and 4 show two channels 12 A and 12 B arranged symmetrically with respect to a longitudinal plane of the throttle valve 6. A greater number of channels may be provided without departing from the scope of the invention. Each channel 12 and each injector 7 associated therewith must preferably be arranged as described above. FIG. 3, which illustrates the zone which injector 7 enters, shows the annular injection sector and FIG. 4 shows the partitioning of this sector into two zones 12 A, 12 B at the origin of the two channels. If two channels are provided, the throttle valve 6 will run twice less fast as the engine in case of an application to a two-stroke engine.

Moreover, a means for trapping the fuel may be provided, according to the invention, downstream from inlet 122.

This means for trapping may include a double deviation of channel 12 which gets further away and then closer to the rotational axis 10 of the throttle valve 6, thus forming a "pocket" 126 which the centrifugal force contributes to fill.

Figure 7:
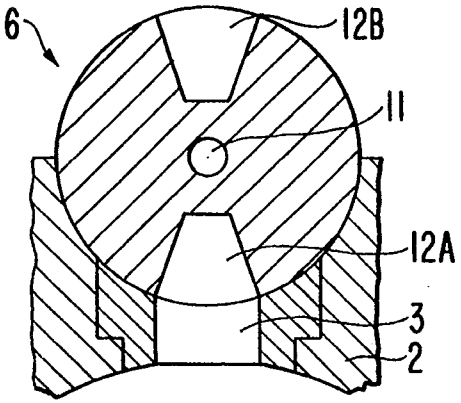
FIG. 7 is a cross-section along the line IV—IV of FIG. 2 also showing the connection with the combustion chamber.
Figure 6:
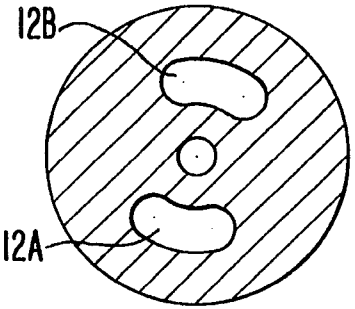
FIG. 6 is a cross-section along the line III—III of FIG. 2.
Figure 5:
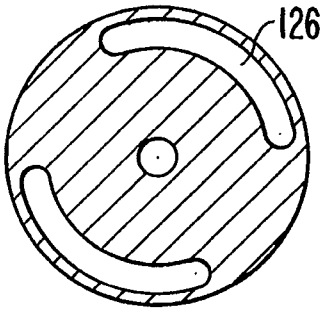
FIG. 5 is a cross-section along the line II—II of FIG. 2.

FIGS. 5, 6 and 7 illustrate the course of channel 12 or more precisely of the two channels 12 A and 12 B provided according to this embodiment, downstream from inlet 122.

The trapping means is intended to complete and to improve the sealing achieved at the level of the inlet 122 of the throttle valve 6.

The end 121 of channel 12 allows the mixture to be supplied in line with the axis of port 3, which is well-known in the art.

Driving into rotation of the rotary or throttle valve 6 may be achieved by any means known in the art (belt, chain, pinions, . . . ) so that the latter is controlled by the engine speed or a submultiple of this speed, according to the number of channels provided.

By virtue of the above-described features of the present invention, no sealing system independent of the throttle valve 6 is necessary at the intake, according to the invention, since sealing is achieved within the throttle valve 6, hence an increased simplification and reliability.

Moreover, at any moment of the cycle other than the intake, the throttle valve 6 is capable of carrying along the fuel particles towards the inside of the channel 12.

Thus, the particles of fuel or of another heavy component of the mixture cannot accumulate unexpectedly at the inlet 122 of the throttle valve 6.

Furthermore, sealing is completed by the means for trapping the heaviest particles of the mixture. This means is advantageously capable of trapping the particles before the intake stage. In fact, this means allows the trapped fuel to be retained and prevented from flowing out towards one or the other of the ends of the throttle valve 6 as long as the intake is closed.

But as soon as the end 121 communicates with the combustion chamber, that is from the beginning of the intake, the variation in pressure allows the particles to be immediately re-introduced into the mixture and sprayed towards the combustion chamber 4.

In the case of multi-cylinder engines, the throttle valves 6 according to the invention may be lined up as shown in FIG. 1, thereby providing a long axial channel 11 intended, preferably, for passage of a cooling fluid. A single system is necessary for driving into rotation all the throttle valves 6 mounted this way.

Although FIGS. 2 to 7 show the case of a throttle valve 6 crossed through by two channels 12, it may be envisaged, without departing from the scope of the invention, that the two channels join near the end 121 opening towards the combustion chamber. The throttle valve(s) 6 thus have the same rotational speed as the engine.

As it has already been stated, more than two channels may run through the throttle valve 6, the speeds of the engine and of the throttle valve 6 being then adapted to one another.

In order to improve the velocity of the mixture flowing through channel(s) 12, the channel(s) 12 may also have a convergent-divergent shape over their length.

Finally, the throttle valves 6 according to the invention may, for example, be made from aluminum, by casting.

Of course, the skilled artisan will be able to provide the throttle valves 6 which have been described with other modifications and/or additions without departing from the scope of the present invention.

It is claimed:

1. A rotary throttle valve for transferring a fluid between a fluid source and a combustion chamber of an internal-combustion engine, the rotary throttle valve comprising at least one substantially cylindrical surface and a side wall, at least one flow channel for transferring said fluid from an inlet to an outlet, wherein the inlet is arranged at a lateral surface of the rotary throttle valve and is positioned at a distance, which is not zero, from a rotational axis of the rotary throttle valve, the outlet is arranged at the cylindrical surface of said rotary throttle valve and is radially offset with respect to said inlet, and wherein at least one fluid injector is arranged in a vicinity of said inlet and a portion of the at least one fluid injector extends inside said rotary throttle valve, said fluid injector being positioned in such a manner that an axis of a jet of fluid generated by the fluid injector has an orientation substantially corresponding to a plane in which a wall of the at least one flow channel is nearest to the rotational axis of the rotary throttle valve.

2. A rotary throttle valve as claimed in claim 1, wherein a plurality of flow channels are arranged in the rotary throttle valve, a fluid injector is provided for each of said channels, a wall of the respective channels furthest from the rotational axis of the rotary throttle valve is inclined in such a manner that the wall is further from said rotational axis than an inlet end of the rotary throttle valve of the respective channels is from said rotational axis.

3. A rotary throttle valve as claimed in one of claims 1 or 2, wherein at least one of said flow channels comprises a means for trapping fluid.

4. A rotary throttle valve as claimed in claim 3, wherein said means for trapping fluid includes an elbow formed by said at least one channel for retaining said fluid under an effect of a centrifugal force generated by rotation of the rotary throttle valve.

5. A rotary throttle valve as claimed in one of claims 1 or 2, further comprising an axial channel for cooling the rotary throttle valve.

6. A rotary throttle valve as claimed in claim 1, wherein, at a predetermined distance from said inlet, two fluid flow channels are arranged symmetrically with respect to a longitudinal plane of the rotary throttle valve.

7. A rotary throttle valve as claimed in one of claims 1 or 2, wherein the fluid is fuel, the fuel injector is a pneumatic fuel injector, and wherein the rotary valve is provided in the internal combustion engine.

8. A rotary throttle valve according to claim 7, wherein the internal combustion engine is a single-cylinder engine.

9. A rotary throttle valve as claimed in claim 7, wherein the internal combustion engine is a multi-cylinder engine, and wherein the rotary throttle valve is disposed at an inlet of each cylinder of the multi-cylinder engine.

10. A rotary throttle valve as claimed in claim 9, wherein a single axial channel extends through all of the throttle valves for enabling a cooling of the rotary throttle valves.

11. A rotary throttle valve as claimed in claim 7, wherein the engine is an outboard engine.

* * * * *